United States Patent [19]

Imazeki et al.

[11] Patent Number: 4,603,370

[45] Date of Patent: Jul. 29, 1986

[54] POWER-SAVING RELAY CIRCUIT

[75] Inventors: Kazuyoshi Imazeki; Nobuaki Yokoyama, both of Tokyo, Japan

[73] Assignee: General Research of Electronics, Inc., Tokyo, Japan

[21] Appl. No.: 657,377

[22] Filed: Oct. 3, 1984

[51] Int. Cl.[4] ..... H01H 47/10

[52] U.S. Cl. ..... 361/155; 307/142; 361/194

[58] Field of Search ..... 361/154, 155, 189, 194, 361/156; 307/132 E, 142

[56] References Cited

U.S. PATENT DOCUMENTS

| | | | |
|---|---|---|---|
| 2,922,086 | 1/1960 | Stidger | 361/156 |
| 3,568,008 | 3/1971 | Tanimura et al. | 361/155 |
| 3,931,551 | 1/1976 | Holt | 361/156 |

*Primary Examiner*—L. T. Hix
*Assistant Examiner*—David M. Gray
*Attorney, Agent, or Firm*—Trexler, Bushnell & Wolters, Ltd.

[57] ABSTRACT

A power-saving relay circuit for reducing power consumption from a power supply comprises a relay including a selectively energizable relay coil, a plurality of movable contactors, and a plurality of fixed contacts including first and second fixed contacts associated with each of the movable contactors. Each of the movable contactors is normally in electrical contact with the first fixed contact and responsive to energization of the relay coil for breaking the electrical contact with the first fixed contact and for making electrical contact with the second fixed contact. A current limiting circuit is coupled in electrical series circuit intermediate a selected one of the second fixed contacts and the relay coil. The movable contactor associated with the selected one of the second fixed contacts is capable of being coupled in circuit with the power supply for completing an electrical circuit through the current limiting circuit for energizing the relay coil.

A method is also provided for reducing power consumption from a power supply by a relay of the type described above. This method comprises providing a current limiting circuit in series circuit intermediate one end of the relay coil and a selected one of the second fixed contacts; and coupling the movable contactor associated with the selected second fixed contact with the power supply.

15 Claims, 1 Drawing Figure

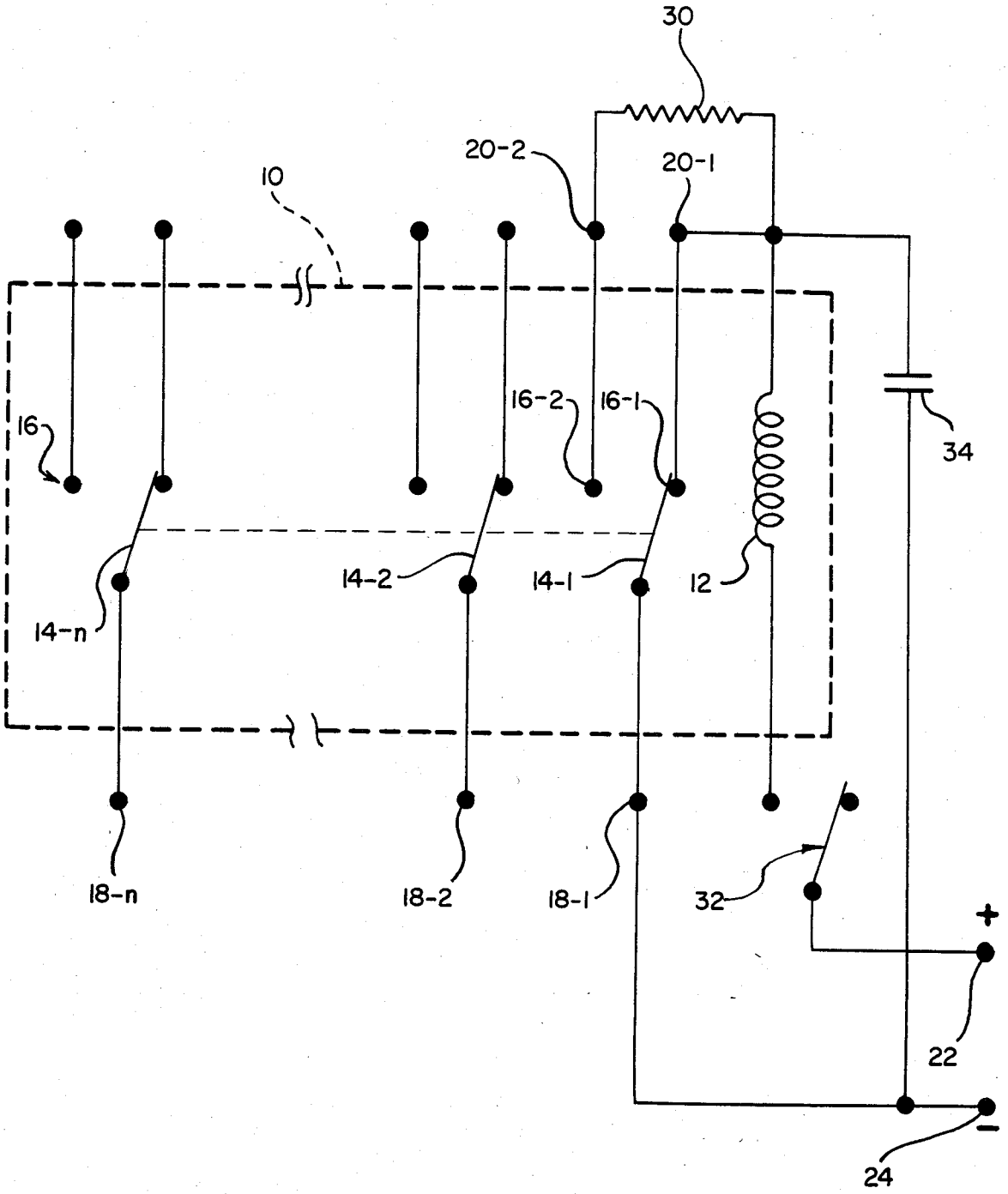
30
20-2
20-1
10
16
16-2
16-1
34
14-n
14-2
14-1
12
18-n
18-2
18-1
32
+
22
−
24

POWER-SAVING RELAY CIRCUIT

BACKGROUND OF THE INVENTION

The present invention is directed generally to relay circuits and more particularly to a novel power-saving relay circuit and to a method for reducing power consumption of a relay circuit.

A relay circuit generally comprises a relay coil for moving or throwing one or more related movable contactor elements or switches between pairs of fixed contacts or terminals. In this regard, a typical relay may include a number of such switches or movable contactors. Each of these movable contactors is responsive to energization of a relay coil for breaking electrical contact with a first or normal closed contact or terminal and making electrical contact with a second or normally open fixed contact or terminal. Thereafer, continued energization of the relay coil holds the respective movable contactors in electrical engagement with the associated second or normally open fixed contacts or terminals.

In many applications, for example in portable battery-powered apparatus, it is desirable to minimize the power consumption of one or more such relays. Most such relays are designed to draw a given current and hence consume a given amount of power to effect the initial movement of the movable contactors or switches between the fixed contacts or terminals. However, after making of the second or normally open contacts, most such relays exhibit from 20 to 50 percent less current consumption and hence correspondingly less power consumption to hold the contactors in engagement with the second or normally open contacts or terminals. Accordingly, most relays consume more power than is necessary, since the associated power circuit usually provides a fixed current through the relay coil when energized.

In view of the foregoing, provision of an additional current limiting resistor in the power circuit to the relay coil would not be appropriate, since this would reduce the current draw and hence power of the coil at all times. This might provide insufficient power to cause the initial breaking of engagement and movement of the movable contactors. However, if the relay coil and a current limiting resistor are placed in circuit with one of the sets of normally open contacts and the associated movable contactor, the relay coil will be without power, and hence unable to operate the relay, during the time when the movable contactor is moving between the normally closed and normally open contacts.

OBJECTS AND SUMMARY OF THE INVENTION

Accordingly, it is a general object of this invention to provide a power-saving relay circuit and a method of reducing power consumption of a relay, while solving the foregoing problems.

In accordance with one aspect of the invention, a power-saving relay circuit for reducing power consumption from a power supply, comprises a relay including a selectively energizable relay coil, a plurality of movable contactors, and a plurality of fixed contacts including first and second fixed contacts associated with each of said movable contactors. Each of the movable contactors is normally in electrical contact with said first fixed contact and responsive to energization of said relay coil for breaking the electrical contact with said first fixed contact and for making electrical contact with said second fixed contact. Current limiting means are coupled in electrical series circuit intermediate a selected one of said second fixed contacts and said relay coil. The movable contactor associated with said selected one of said second fixed contacts is capable of being coupled in circuit with the power supply for completing an electrical circuit through the current limiting means for energizing the relay coil.

In accordance with another aspect of the invention, there is provided a method of reducing power consumption from a power supply of a relay of the type described above, said method comprising: providing current limiting means in series circuit intermediate one end of said relay coil and a selected one of said second fixed contacts; and coupling the movable contactor associated with the selected second fixed contact with the power supply.

BRIEF DESCRIPTION OF THE DRAWING

The features of the present invention which are believed to be novel are set forth with particularity in the appended claims. The organization and manner of operation of the invention, together with further objects and advantages thereof, may best be understood by reference to the following description taken in connection with the accompanying drawing in which like reference numerals identify like elements, and in which:

The FIGURE is a schematic circuit diagram illustrating a power-saving relay circuit in accordance with the invention.

DETAILED DESCRIPTION OF THE ILLUSTRATED EMBODIMENT

Referring now to the drawing, a power-saving relay circuit in accordance with the invention is illustrated in schematic circuit diagrammatic form. A relay designated generally by reference numeral 10 and enclosed in dashed line includes a relay coil 12 and a plurality of movable contactors 14-1, 14-2 . . . 14-n. The relay also includes a plurality of fixed contacts 16, two of which are associated with each of the plurality of movable contactors. In this regard, first and second ones of these fixed contacts, 16-1 and 16-2. are associated with the movable contactor 14-1.

In operation, each of the movable contactors is responsive to energization of the relay coil 12 for breaking the electrical contact with the first associated fixed contact and making electrical contact with the second associated fixed contact. For example, the movable contactor 14-1 is normally in engagement with first or "normally closed" fixed contact 16-1; however, upon energization of the coil 12, the first movable contactor 14-1 will break the engagement with first or normally closed fixed contact 16-1 and move or be thrown into engagement with second or "normally open" fixed contact 16-2. In this regard, all of the remaining movable contactors 14-2 through 14-n are operative in unison in response to the energization of coil 12, and absent energization of coil 12 all these movable contactors remain in engagement with their associated first or normally closed fixed contacts.

With further reference to the circuit illustrated it will be seen that each of the movable contactors is electrically coupled with an external terminal or electrode 18-1, 18-2 . . . 18-n. Similarly, each of the fixed contacts 16-1, 16-2, etc. is coupled with an external terminal or electrode 20-1, 20-2, etc. While the foregoing construction of the relay 10 is conventional, it will be appreciated that its use in cooperation with the novel power-saving circuit arrangement to be described results in a novel power-saving relay circuit in accordance with the invention.

Advantageously, the power-saving relay circuit of the invention is adapated to reduce the power consumption of the relay 10 from a power supply which is diagrammatically indicated by positive and negative terminals or electrodes 22 and 24. In this regard, it will be recognized that the relay coil 12 requires a given amount of current and hence a given amount of power to effect the described disengagement, movement and subsequent making of electrical contact with the respective second or normally open fixed contacts by the respective movable contactors. However, most relays such as relay 10 require considerably less current through relay coil 12, and hence less power, to hold the respective movable contactors in engagement with their respective second or normally open contacts once the initial making of these contacts has been accomplished. Typically, the latter reduced current consumption is on the order of from 20 to 50 percent less than the initial current draw.

In accordance with a feature of the invention, current limiting means, which in the illustrated embodiment take the form of a resistor 30, are coupled in electrical series circuit intermediate a selected one of the second or normally open fixed contacts and one end of the relay coil 12. In the illustrated embodiment, the second fixed contact 16-2 is selected for this purpose. Additionally, the movable contactor 14-1 associated with the selected second fixed contact 16-2 is coupled in circuit with the power supply 22, 24 so as to complete an electrical circuit through the current limiting means or resistor 30 for energizing the relay coil 12. Accordingly, one end of the relay coil is coupled with the current limiting resistor 30 in a series circuit between positive and negative terminals 22, 24 of the power supply when the movable contactor 14-1 is energized by the relay coil 12 into engagement with the second or normally open fixed contact 16-2.

In the illustrated embodiment, additional switching means in the form of a single-pole, double-throw switch 32 is also coupled in circuit with the relay coil and power supply for selectively energizing the relay coil from the power supply. This additional switch 32 is illustrated coupled intermediate the positive terminal 22 of the power supply and the other end of relay coil 12 (i.e., its end opposite its connection with current limiting resistor 30). Hence, the switch 32 may selectively be opened or closed to open or close the circuit between the power supply and the relay coil 12. The polarity of the illustrated connections to the power supply may be reversed without departing from the invention.

In accordance with a further aspect of the invention, further or additional circuit means, which in the illustrated embodiment takes the form of a capacitor 34, is capable of being coupled in circuit with the relay coil 12 and with the power supply 22, 24 to provide an additional current path for energizing relay coil 12. This additional circuit element or capacitor 34 is coupled in series circuit intermediate the first end of the relay, which is also coupled with current limiting resistor 30, and the power supply 22, 24. In the illustrated embodiment, the capacitor 34 is coupled to the negative side or terminal 24 of the power supply. Moreover, the first end of the coil, that is, its junction with current limiting resistor 30 and the additional circuit element or capacitor 34, is also coupled with the first or normally closed fixed contact 16-1 associated with the selected second or normally open fixed contact 16-2.

In operation, the foregoing circuit arrangement advantageously provides power or energizing current through the relay coil 12 whenever the switch 32 is actuated, without regard to the relative position of the movable contactor 14-1. For example, when the movable contactor 14-1 is engaged with the first or normally closed fixed contact 16-1, the current path is directly through this contact 16-1 and movable contactor 14-1. Similarly, when the movable contactor 14-1 is a position intermediate the two fixed contacts 16-1 and 16-2 the current path is through the additional circuit element or capacitor 34. Finally, when the movable contactor makes contact with second or normally open fixed contact 16-2 the current path is through current limiting resistor 30, fixed contact 16-2 and movable contactor 14-1.

Advantageously, in the last position of movable contactor 14-1, current limiting resistor 30 is brought into circuit with relay coil 12 thus substantially reducing the current flow through, and hence the power drawn by, the relay coil 12. As discussed above, such current and power reduction is possible because the relay coil typically requires substantially less current to hold the respective movable contactors in engagement with their respective second or normally open contacts once they have been thrown to or make this contact. Moreover, it will be noted that once the capacitor 34 becomes charged during the movement of movable contactor 14-1, it does not consume further electric power.

Alternatively, a resistor similar to resistor 30 may be utilized as the additional or further circuit element, in place of the capacitor 34. However, when such a resistor is utilized, it will be noted that this resistor will be placed in parallel circuit with current limiting resistor 30 when movable contactor 14-1 is in engagement with second fixed contact 16-2. Hence, the value of resistor 30 is preferably increased in the case where a resistor is used in place of capacitor 34 to take into account this parallel circuit configuration and still achieve the same current reduction through relay coil 12. Additionally, it will be recognized that the respective positive and negative terminals 22 and 24 of the power supply may be coupled in reverse plurality from the indicated and described circuit connections without departing from the invention. It will be noted that the remaining relay terminals which are switched by remaining movable contactors 14-2 through 14-n inclusive may be utilized to make and break other circuit connections as desired, only the single movable contactor 14-1 and its associated fixed contacts 16-1 and 16-2 being utilized in the power reducing circuit of the invention.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true scope of the invention.

The invention is claimed as follows:

1. A power-saving relay circuit for reducing power consumption from a power supply, comprising: a relay including a selectively energizable relay coil, a plurality of movable contactors, and a plurality of fixed contacts including first and second fixed contacts associated with each of said movable contactors; each of said movable contactors being normally in electrical contact with said first fixed contact and responsive to energization of said relay coil for breaking the electrical contact with said first fixed contact and for making electrical contact with said second fixed contact; current limiting means coupled in electrical series circuit intermediate a selected one of said second fixed contacts and said relay coil; the movable contactor associated with said selected one of said second fixed contacts being capable of being coupled in circuit with said power supply for completing an electrical circuit through said current limiting means for energizing said relay coil.

2. A circuit according to claim 1 and further including additional circuit means capable of being coupled in circuit with said relay coil and with said power supply to form an additional current path for energizing said relay coil.

3. A circuit according to claim 1 and further including switching means coupled intermediate said power supply and said relay coil for selectively energizing said relay coil.

4. A circuit according to claim 2 and further including switching means coupled intermediate said power supply and said relay coil for selectively energizing said relay coil.

5. A circuit according to claim 1 wherein said current limiting means comprises a resistor.

6. A circuit according to claim 2 wherein said additional circuit means comprises a capacitor.

7. A circuit according to claim 2 wherein said additional circuit means comprises a resistor.

8. A circuit according to claim 2 wherein said additional circuit means is also coupled intermediate the power supply and the first fixed contact associated with said selected second fixed contact.

9. A method of reducing power consumption from a power supply of a relay comprising a relay coil, a plurality of movable contactors and a plurality of fixed contacts including first and second fixed contacts associated with each said movable contactor, each of said movable contactors being normally in electrical contact with said first fixed contact and responsive to energization of said relay coil for breaking the electrical contact with said first fixed contact and making electrical contact with said second fixed contact; said method comprising: providing current limiting means in series circuit intermediate one end of said relay coil and a selected one of said second fixed contacts; and coupling the movable contactor associated with said selected second fixed contact with said power supply.

10. A method according to claim 9 and further including providing switching means for selectively coupling said power supply with the other end of said relay coil.

11. A method according to claim 9 and further including providing further circuit means coupled in series circuit intermediate said one end of said relay coil and said power supply.

12. A method according to claim 11 and further including providing switching means for selectively coupling said power supply with the other end of said relay coil thereby completing an electrical circuit through said relay coil and said further circuit means for energizing said relay coil.

13. A method according to claim 10 wherein the step of coupling said movable contactor with said power supply comprises coupling said movable contactor with a negative side of said power supply; and further including coupling said switching means intermediate a positive side of said power supply and said other end of said relay coil.

14. A method according to claim 12 and further including coupling said further circuit means intermediate said one end of said relay coil and a negative side of said power supply and coupling said switching means intermediate a positive side of said power supply and the other end of said relay coil.

15. A method according to claim 10 and further including coupling said one end of said relay coil with the first fixed contact associated with the selected second fixed contact.

* * * * *